United States Patent [19]

Smith, Jr. et al.

[11] 4,345,864

[45] Aug. 24, 1982

[54] PIPE MANIPULATOR

[75] Inventors: Roger Smith, Jr.; Faustyn C. Langowski, both of Georgetown, Tex.

[73] Assignee: BJ-Hughes Inc., Round Rock, Tex.

[21] Appl. No.: 130,762

[22] Filed: Mar. 17, 1980

[51] Int. Cl.[3] ..... E21B 19/15

[52] U.S. Cl. ..... 414/22; 414/753; 414/917; 175/85; 211/60 S

[58] Field of Search ..... 414/22, 745, 749, 751, 414/753, 917; 175/85; 211/60 S

[56] References Cited

U.S. PATENT DOCUMENTS

| | | | |
|---|---|---|---|
| 3,655,071 | 4/1972 | Langowski et al. | 414/22 |
| 3,710,954 | 1/1973 | Hutchison | 414/751 X |
| 3,883,009 | 5/1975 | Swoboda, Jr. et al. | 414/745 X |
| 3,888,360 | 6/1975 | Ando et al. | 414/753 X |
| 4,077,525 | 3/1978 | Callegari et al. | 414/22 |
| 4,274,778 | 6/1981 | Putnam et al. | 414/22 |

*Primary Examiner*—Robert W. Saifer

*Attorney, Agent, or Firm*—Robert A. Felsman

[57] ABSTRACT

Apparatus for moving stands of pipe in a derrick having a powered turret mounted in a selected position relative to the derrick and a vertical leg supported and rotated by the turret. A powered dolly is mounted on the vertical leg and moves one end of a power arm to selected positions along the vertical leg. A pipe gripping head is mounted to the opposite end of the power arm. A scissor arm is rotatably connected at one end in mid-region of the power arm and at the other end to the vertical leg. As a consequence, the pipe gripping head moves reciprocally in a straight line to engage, move, and disengage stands of pipe.

4 Claims, 11 Drawing Figures

PIPE MANIPULATOR

BACKGROUND OF THE INVENTION

1. Field of the Invention:

This invention relates in general to an apparatus used in drilling operations, and in particular, to an apparatus used on a rig for moving stands of pipe between the rotary and the setback or rack area.

2. Description of the Prior Art:

Rotary drilling rigs utilize sections of drill pipe and drill collars which are threaded together or "made up" when the drill stem is being placed in the hole. Conversely, the drill pipe sections and drill collars are "broken out" when the drill stem is being removed from the hole. In off-shore operations, drill pipe is lead through stands of marine riser pipe which must also be transferred and handled on the rig.

The transfer of stands of pipes between the rotary table and a setback area where the stands are racked has been a difficult and hazardous manual operation in the past. Because of the large weight of the stands of pipe great strength and physical stamina are required of the drilling crews. A serious accident could result should the crew lose control of a stand.

As a consequence, it has for years been thought desirable and advantageous to provide a mechanical device for transferring stands between the rotary and the setback or racking area in a drill rig. A mechanical system should be safer since greater strength and a more positive control is possible. A reduction in crew fatigue can be achieved. A mechanical device can be remotely operated, and as a result, safety can be enhanced. In addition, the transfer time can be decreased, thereby reducing trip time to increase efficiency.

In pursuit of the above objects, mechanical pipe handling systems for drill rigs has been available for a number of years.

A successful pipe handling system is disclosed in the publication, "1978–1979 BJ Hughes Oilfield Products and Systems" catalogue, page 308–310. The manipulators in this system consist of a number of carriages transversely aligned within the derrick, each of which includes an arm to support a pipe gripping head. Although the system is relatively simple and reliable, it requires special derrick modifications and a different racking sequence than that usually used by derrick personnel.

Golar-Nor Offshore A/S of Oslow, Norway has a system consisting of a cylinder pivotally attached by a turret to a dolly movably mounted on a track secured to the lower side of the monkeyboard in the derrick. A pipe gripping head is mounted on the end of the cylinder rod, and although the mechanism is relatively simple, it is excessively space consuming because the retracted length of the cylinder, rod and pipe gripping head is greater than the stroke of the cylinder. A better understanding of this type of device maybe seen with reference to U.S. Pat. No. 4,117,941.

Another system is shown in the pending application of Paul S. Putnam et al, entitled "Mechanized Stand Handling Apparatus for Drilling Rings", Ser. No. 833,145, filed Sep. 14, 1977 now U.S. Pat. No. 4,274,778. This system employs an articulated arm, pivotally joined in the middle, and further interconnected through linkages, gears, master-slave cylinders, or combinations thereof, so that motion of one section causes relative motion of the second section to require the pipe gripping head to travel in essentially a straight line while remaining in a horizontal position at all times. This mechanism is relatively complex and presents difficulties in decreasing size and weight, an important consideration since stresses in derricks should be minimized. The system does have the advantage, however, of retraction into a sufficiently small space and provides relatively large racking capacity at the setback, fingerboard or racking area.

SUMMARY OF THE INVENTION

It is a general object of this invention to provide a simple, lightweight, easy to operate, and dependable system for assisting in racking stands of pipe in drilling and workover rigs, one that is retractable into a small space to permit use of standard racking sequences.

It is also an object of this invention to provide a pipe manipulator for use on drilling rigs which is sturdy enough to handle marine riser pipe without substantial modification.

In accordance with these objects, the apparatus includes a powered turret mounted at a selected position on the derrick and supporting a depending vertical leg. Mounted on the vertical leg is a powered dolly which supports one end of a power arm. The other end of the power arm supports a pipe gripping head. A scissor arm extends from a select one of the turret or vertical legs and is rotatably connected to the power arm.

In a preferred embodiment, the scissor arm is connected at one end to a point on the leg in vertical alignment with the point at which the power arm is connected to the dolly and at the other end to the mid-region of the power arm. The resulting straight-line mechanism allows the pipe gripping head to move in a straight line to engage, move, and disengage stands of pipe. To insure the pipe gripping head maintains a horizontal attitude, a cross bar having two pivot points is connected at the first pivot point coincidentally with the end of the scissor arm in the mid-region of the power arm. A first support arm is connected at one end to the second pivot point of the cross bar and at the other end to the turret or leg at a point near to and horizontally aligned with the point at which the scissor arm is connected to the turret or leg. A second support arm is coincidentally connected at one end to the second pivot point of the cross bar and at the other end to the pipe gripping head at a point near to and horizontally aligned with the point at which the power arm is connected to the pipe gripping head. The distance between these last two points, between the pivot points of the cross bar, and between the points at which the first support arm and scissor arms connect to the leg or turret are all pproximately the same.

Biasing means connected to the vertical leg facilitates movement of the pipe gripping head away from the leg when in the fully retracted position.

Additional objects, features and advantages of the invention will become apparent in the following detailed description.

DESCRIPTION OF THE PREFERRED EMBODIMENT

Figure 1:
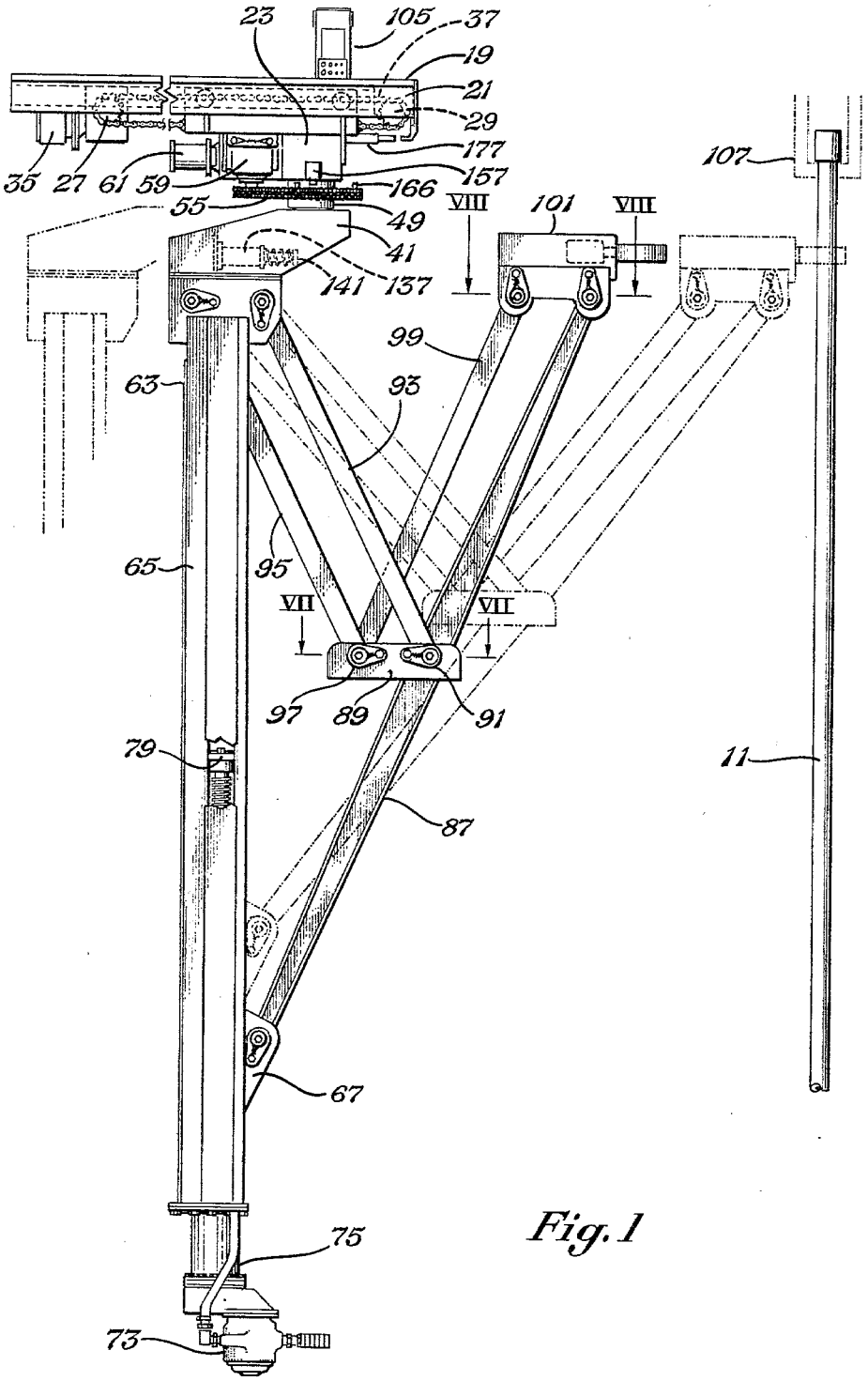
FIG. 1 is a side view of the pipe manipulator apparatus which encompasses the principles of this invention with a portion of the leg broken away.
Figure 9:
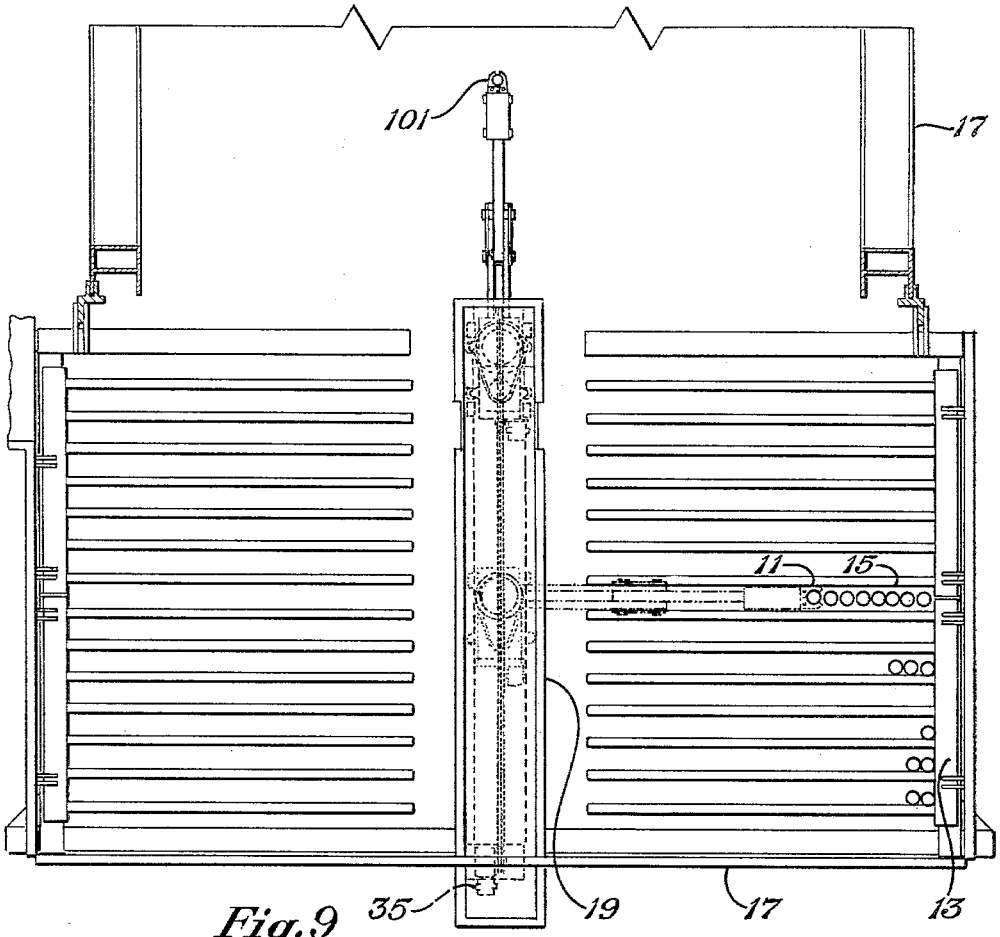
FIG. 9 is a top view of the fingerboard used to rack stands of pipe which are positioned by the gripping head of the apparatus.

From the above prior art description, summary of the invention and description of the drawings it should be apparent that the overall object of the invention is to provide an apparatus as shown in FIGS. 1 through 11 for use in a drilling rig (not shown) for racking stands of pipe including drill pipe tubing, collars, or risers within a fingerboard, generally shown at 13 in FIG. 9 of the drawing. The apparatus could also be used in a "workover" rig once drilling operations are complete and should not be considered as limited solely to drilling rigs. The fingerboard 13 comprises racks 15 connected to a derrick 17 which supports a monkeyboard 19 between the racks 15 from which the pipe handling apparatus of FIG. 1 is supported. It should be understood, however, that the pipe handling apparatus need not be supported from the monkeyboard but can be supported elsewhere in the derrick or on the floor of the drilling rig.

Figure 2:
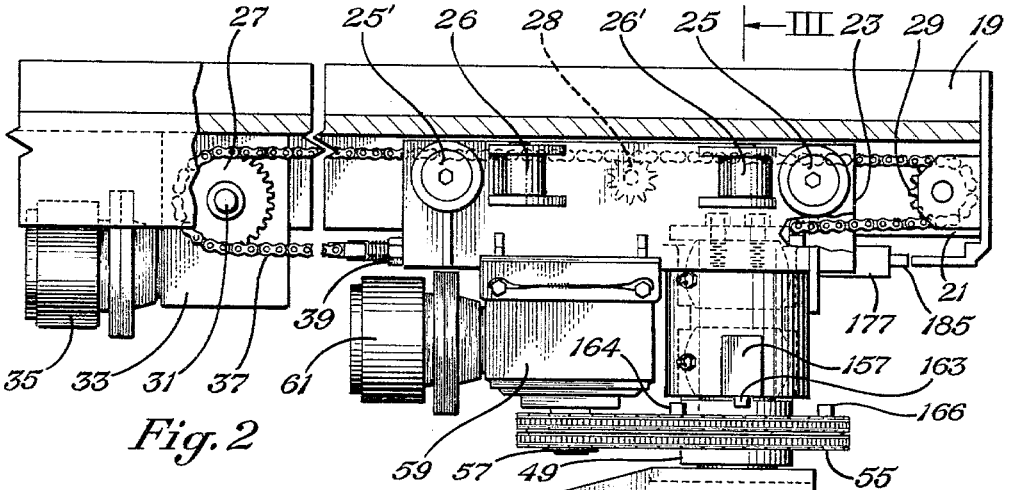
FIG. 2 is a side view of the upper part of the apparatus of FIG. 1 with a portion of the turret and track cut away.
Figure 8:
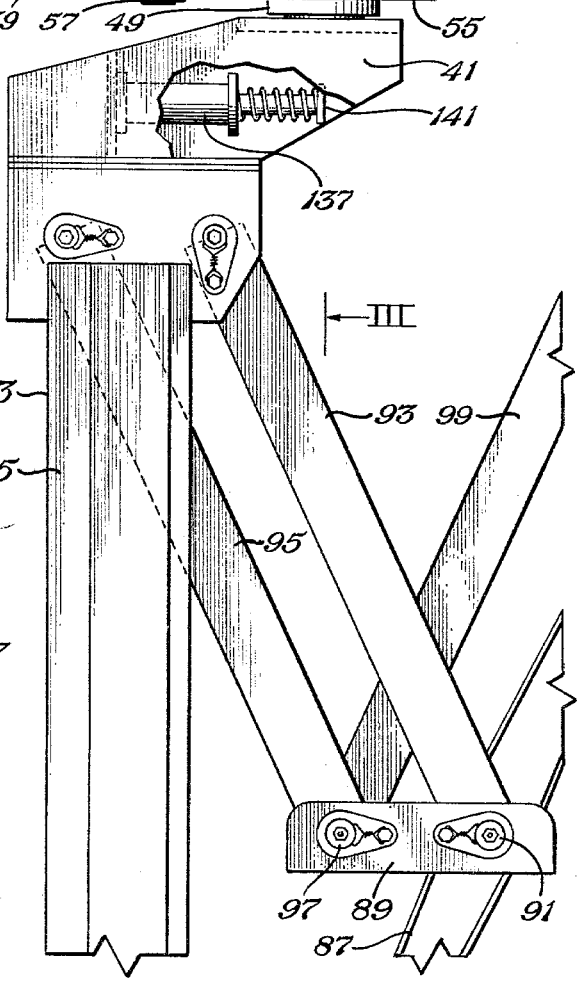
FIG. 8 is a sectional view of the base of the pipe gripping head as seen by looking along lines VIII—VIII of FIG. 1.
Figure 8:
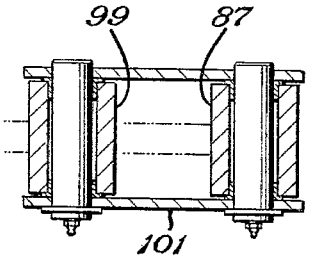
Figure 7:
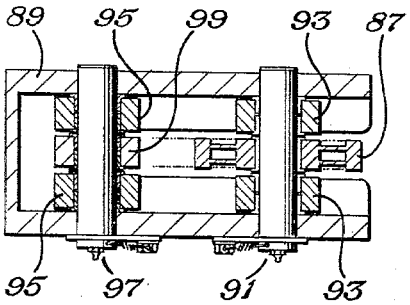
FIG. 7 is a sectional view of the cross bar as seen by looking along lines VII—VII in FIG. 1.
Figure 3:
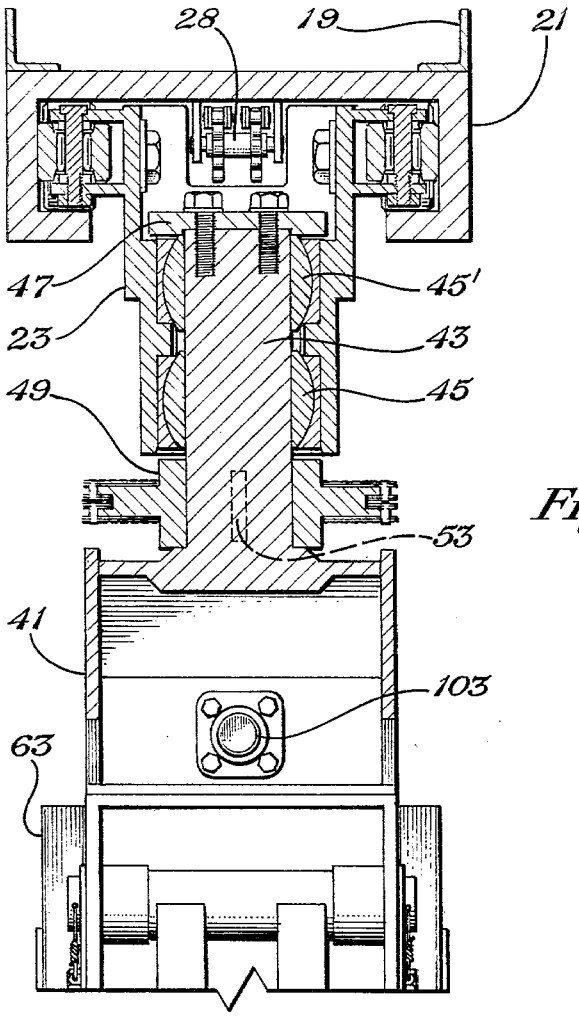
FIG. 3 is a front view of the upper part of the apparatus of FIG. 1 showing a sectional view of the trolley and track as seen by looking along lines III—III of FIG. 2.

A horizontal track 21 is shown in FIG. 2 as including a C-shaped channel rigidly connected to the undersurface of the monkeyboard 19 in this instance. As shown in FIG. 2 and 3, a powered trolley 23 is movably supported by rollers 25, 25' within the track 21 and may be moved to selected horizontal positions on the track. Side rollers 26, 26' are mounted on the side of the trolley 23 to assure axial alignment. As may be seen with reference to FIG. 2 a drive sprocket 27 is mouted near the inner end of track 21 and idler sprocket 29 is mounted at the outer end of the track. The drive sprocket 27 is secured to shaft 31 and driven in either the clockwise or counterclockwise direction through a gearbox 33 and an air motor 35. A drive chain 37 spans the sprockets 27, 29 with ends 39 attached to the trolley. Support sprocket 28 is mounted between drive sprocket 27 and idler sprocket 29 and helps support drive chain 37.

Thus, as the drive sprocket 27 is rotated in the counterclockwise direction (as seen in FIG. 2) the trolley will be pulled horizontally to the right to a selected position. Conversely, rotation of the drive sprockets 27 in the clockwise direction will pull the trolley 23 to a selected position toward the left.

A cam operated valve 177 and cam actuator 185 are positioned on trolley 23. As seen in FIG. 2, pulling the trolley 23 completely to the right engages cam actuator 185.

As shown in greater detail in FIGS. 2 and 3, a turret 41 is rotatably suspended from the trolley 23 and includes a shaft 43 (see FIG. 3) supported on suitable bearings 45, 45' suspended from a thrust plate 47 for rotation relative to the trolley 23. The lower end of the shaft 43 is connected with a hub of a driven sprocket 49 by a key 53. The driven sprocket 49 (see FIG. 2) is in this instance a double sprocket rotated in a clockwise or counterclockwise motion by a double chain 55 pulled by a pair of drive sprockets 57. A gear box 59, driven by an air motor 61, moves the chain such that the turret 41 can be positioned at any selected angle.

A second cam operated valve 157 and cam actuator 163 are mounted on turret 41. Left cam 164 and right cam 166 are located on driven sprocket 49 and strike the cam actuator 163 as the driven sprocket 49 is rotated.

Suspended from the lower end of the turret 41 is a generally vertical leg 63 including a track 65 (see FIGS. 4 and 5), which in this instance is a C-shaped channel similar to that used in the horizontal track 21.

Figure 6:
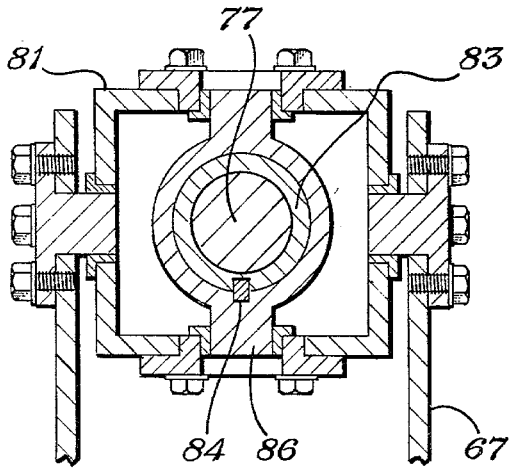
FIG. 6 is a sectional view of the dolly as seen by looking along lines VI—VI of FIG. 4.
Figure 4:
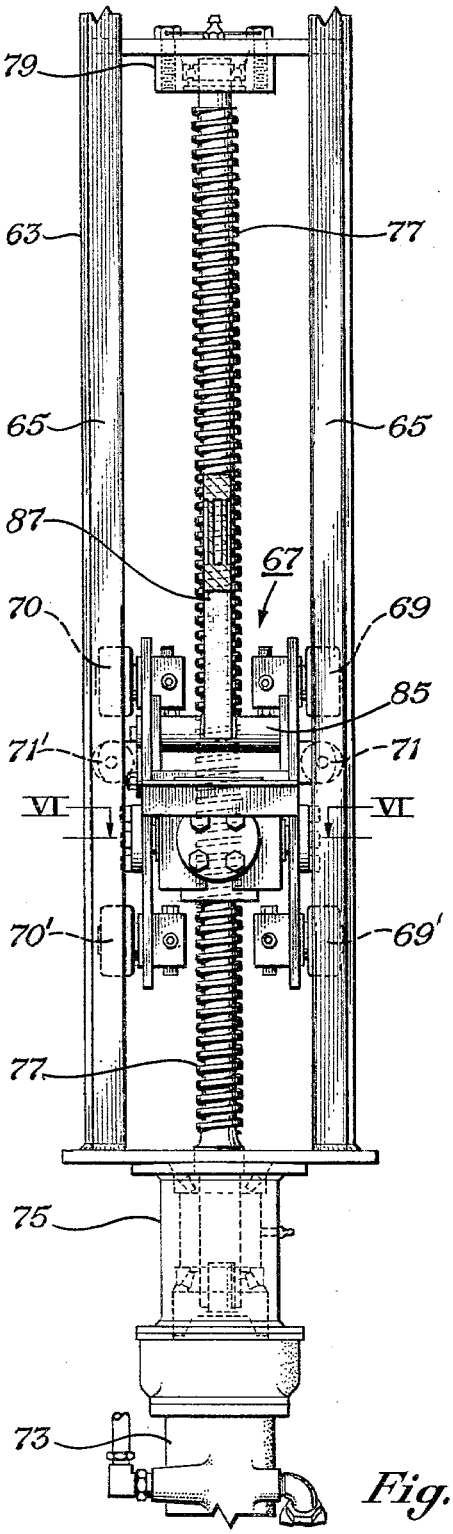
FIG. 4 is a back view of the lower part of the apparatus of FIG. 1.
Figure 5:
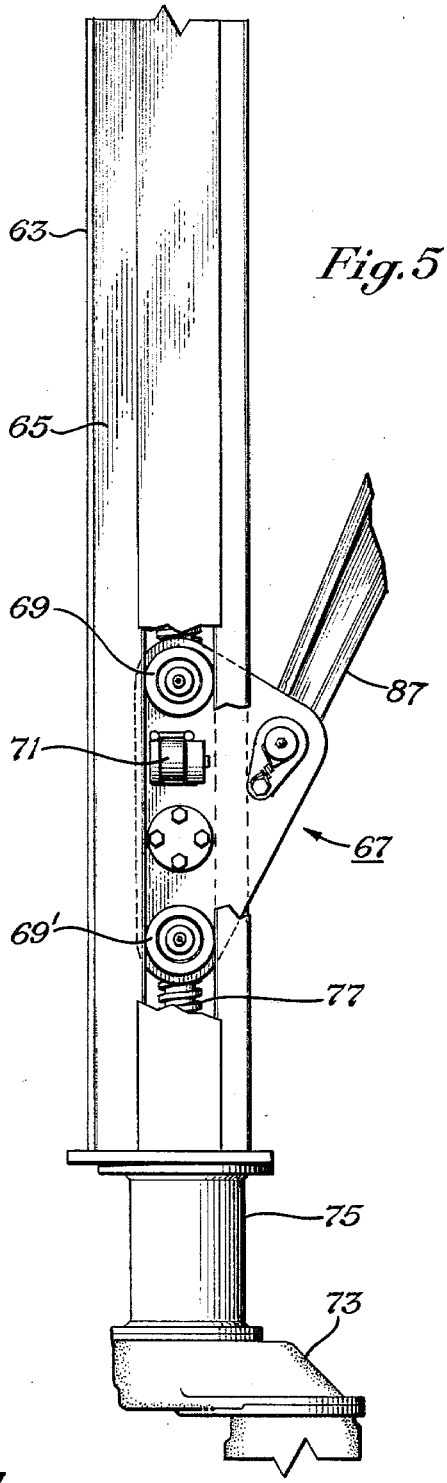
FIG. 5 is a side view of the lower part of the apparatus of FIG. 1 with a portion of the leg broken away.

The vertical track 65 is adapted to receive a powered dolly 67 having rollers 69, 69', 70, 70', confined within the track 65, and as shown in FIG. 4 side rollers 71, 71' to assure axial alignment of the dolly within the track. Near the lower end of the track 65 is an air motor 73, which through a reduction gear system and adapter 75, rotates a threaded shaft or worm gear 77, the upper end of which terminates as shown in FIG. 4 in a bearing support structure 79 secured to the track. As shown in FIG. 6, the dolly 67 is connected to a pivot housing 81 within which is supported a drive nut 83 secured by retaining pin 84 to drive nut housing 86. When the shaft 77 is rotated, the dolly 67 moves up or down within the track 65 to selected positions. The pivot housing permits some play between the nut, shaft, dolly, and track to minimize stresses on these components.

Figure 10:
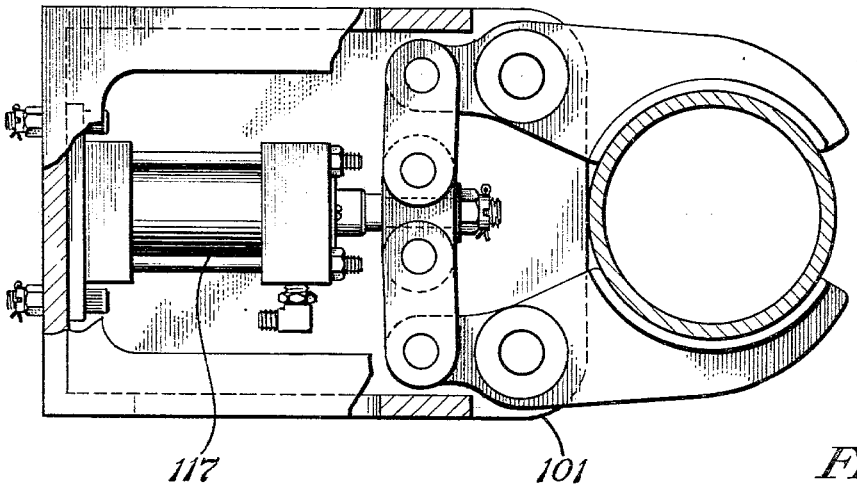
FIG. 10 is a top view of a gripping head suitable for use with the pipe manipulator apparatus of this invention shown with a portion of the head broken away.

Also supported within the dolly 67 is a horizontal bearing support 85 (see FIG. 4) upon which is rotatably supported the lower end of a power arm 87. A pipe gripping head 101 is mounted to the other end of the power arms shown in FIG. 1. A suitable pipe gripping head for use with the present invention is shown in FIG. 10 and discussed in a co-pending application by Faustyn C. Langowski entitled "PIPE GRIPPING HEAD" Ser. No. 130,761, now U.S. Pat. No. 4,304,433, filed concurrently herewith, the disclosure of which is hereby incorporated by reference. Other pipe gripping heads which can be used with the present invention are known in the art. A cross bar 89 (See FIGS. 1 and 7) having first and second pivot points is connected at the first pivot point 91 to the mid-region of the power arm 87. A scissor arm 93 is rotatably connected coincidentally at the first pivot point of the cross bar 89 at one end and is rotatably carried by a select one of the vertical leg 63 and turret 41 at the other end. In this example, the vertical leg 63 was selected.

A first support arm 95 is rotatably connected at one end to the second pivot point 97 of the cross bar 89 and at the other end to the vertical leg 63 at a point near to and horizontally aligned with the point at which the scissor arm 93 is connected to the vertical leg 63, the first support arm 95 being of equal length to the scissor arm 93. A second support arm 99 is rotatably connected coincidentally at one end to the second pivot point 97 of cross bar 89 and at the other end to the pipe gripping head 101 at a point near to and horizontally aligned with the point at which the power arm 87 is connected to the pipe gripping head (see FIG. 8).

The distance between these last two points, between the pivot points 91 and 97, and between the points at which the first support arm 95 and the scissor arm 93 connect to the vertical leg 63 should all be approximately equal. By keeping these distances the same, keeping first pivot point 91 in the mid-region of power arm 87, and keeping the lengths of the scissor arm 93 and first support arm 95 the same, a pair of parallelograms are defined which cause the pipe gripping head 101 to maintain a horiozontal attitude as it is extended and retracted. The turret 41, shown in FIG. 2, is provided with biasing means comprising a cam operated valve 137 and cam actuator 141 to minimize shock loading on the turret 41 and facilitate movement of the gripping head 101 from the fully retracted position as will be discussed later.

Control mechanisms for the present invention are known in the art. The preferred control mechanism for the apparatus is shown schematically in FIG. 11. Along the bottom edge of the diagram are four control valves connected to a common pressure source 109. Beginning on the right side of the diagram, pressure since 109 supplies fluid through line 111 to the head control valve 113. Valve 113 is a two position four-way valve with detent which in the position shown allows pressure to flow along line 115 to one end of hydraulic cylinder 117 in the gripping head 101 to open the head. When valve 113 is shifted to the right, fluid passes along line 119 to the opposite end of fluid cylinder 117 to close the head 101.

The mechanism for controlling the power arm 87 is shown in the upper right corner of the diagram. Pressure source 109 supplies fluid pressure through line 121 to the power arm control valve 123. Valve 123 is a three position four-way valve with spring centering. When valve 123 is shifted to the right, pressure travels up line 129 to a pilot operated spring return three-way valve 135 where flow is initially blocked. Pressure also flows along line 131 to a cam-operated two position spring return four-way valve 137. In the position shown, pressure flows out port 139 providing a pilot signal to valve 135. Valve 135 is shifted to the left allowing pressure to flow up line 129 to rotate dolly motor 73 in the counterclockwise direction and retract power arm 87. When power arm 87 is fully retracted, cam actuator 141 on valve 137 is engaged shifting valve 137 upward. Upward movement of valve 137 blocks the flow of pressure from port 139 and allows excess pressure to be exhausted from port 143. Valve 135 is spring driven back to the right to block the flow of pressure to motor 73.

Shifting power arm control valve 123 to the left allows pressure to flow along line 125 to a second pilot operated valve 127 where flow is initially blocked. Pressure flows along line 145 providing a pilot signal to valve 127 shifting valve 127 to the right. Pressure can then flow up line 125 to rotate motor 73 in the clockwise direction and extend the power arm 87. Centering the power arm control valve 123 cuts off the pilot signal 145 to valve 127, stops the rotation of motor 73, and stops the movement of the power arm.

The trolley 23 and turret 41 are operationally interrelated as shown in the center and left hand portions of the diagram. Pressure from source 109 travels up line 147 to the trolley control valve 149 which is identical in design to the power arm control valve 123. Shifting valve 149 to the right allows pressure to flow up line 151 to valve 153 where flow is initially blocked. Valve 153 is a pilot operated valve identical to valves 127 and 135 previously described. Pressure flows up line 155 to a second cam-operated valve 157 identical to valve 141. In the position shown, pressure flows out port 159 to provide a pilot signal to valve 153 shifting valve 153 to the left. This movement allows flow to continue up line 151 through valve 161 to turret motor 61 causing the turret 41 to rotate.

When the turret has rotated ninety degrees, cam actuator 163 on valve 157 is engaged by right cam 166 (See FIG. 2) causing valve 157 to shift upward. Flow is blocked from port 159 and flows out port 165 instead to provide a pilot signal to valve 167. The pilot signal shifts valve 167 to the left allowing pressure to flow up line 169 to trolley motor 35 to cause clockwise rotation of the drive sprocket 27 and move the trolley 23 along track 21 (FIG. 1) to the left. By centering the trolley control valve 149, flow to valve 157 and hence the pilot signal to valve 167 is cut off stopping pressure flow up line 169. Pressure to motor 35 is blocked and the trolley 23 stops moving along track 21.

Shifting the trolley control valve 149 to the left allows pressure to flow up line 171 where flow is initially blocked at another pilot operated valve 173. Flow continues along line 175 to cam-operated valve 177. Flow passes out port 179 to provide a pilot signal to valve 181, shifting valve 181 to the left. Pressure then flows up line 183 to trolley motor 35 to rotate drive sprocket 27 in a counterclockwise direction and move the trolley 23 along track 21 to the right (see FIG. 1). When the trolley 23 reaches the end of track 21, cam actuator 185 is engaged on valve 177 shifting valve 177 upward (See FIG. 2). Upward movement of the valve 177 cuts off the pilot signal to valve 181 and stops the pressure flow to motor 35. Simultaneously, pressure flows out port 187 of valve 177 providing a pilot signal to valve 173 and shifting valve 173 to the left. Pressure then flows up line 171 through valve 161 to turret motor 61 causing its counterclockwise rotation. When the trolley control valve 149 is shifted to center, the flow of pressure to valve 173 and motor 61 is cut off, stopping rotation of the motor.

Pressure is supplied from source 109 to the right-left selector valve 191 through line 189. In the position shown, pressure is blocked at valve 191. By shifting valve 191 to the left, a pilot signal is sent up line 193 to pilot operated valve 161 to shift valve 161 to the left. Shifting valve 161 to the left reverses the flow of pressure up lines 151 and 171 respectively causing motor 61 to rotate ninety degrees in the opposite direction from that previously described when the trolley control valve 149 is shifted.

In operation, an operator stands upon the board 19 at a control console 105 to operate the apparatus (see FIGS. 1 and 9). A stand of pipe 11 is uncoupled from the drill pipe held by slips in the rotary table (not shown) and lifted into a set back area by elevators 107.

Figure 11:
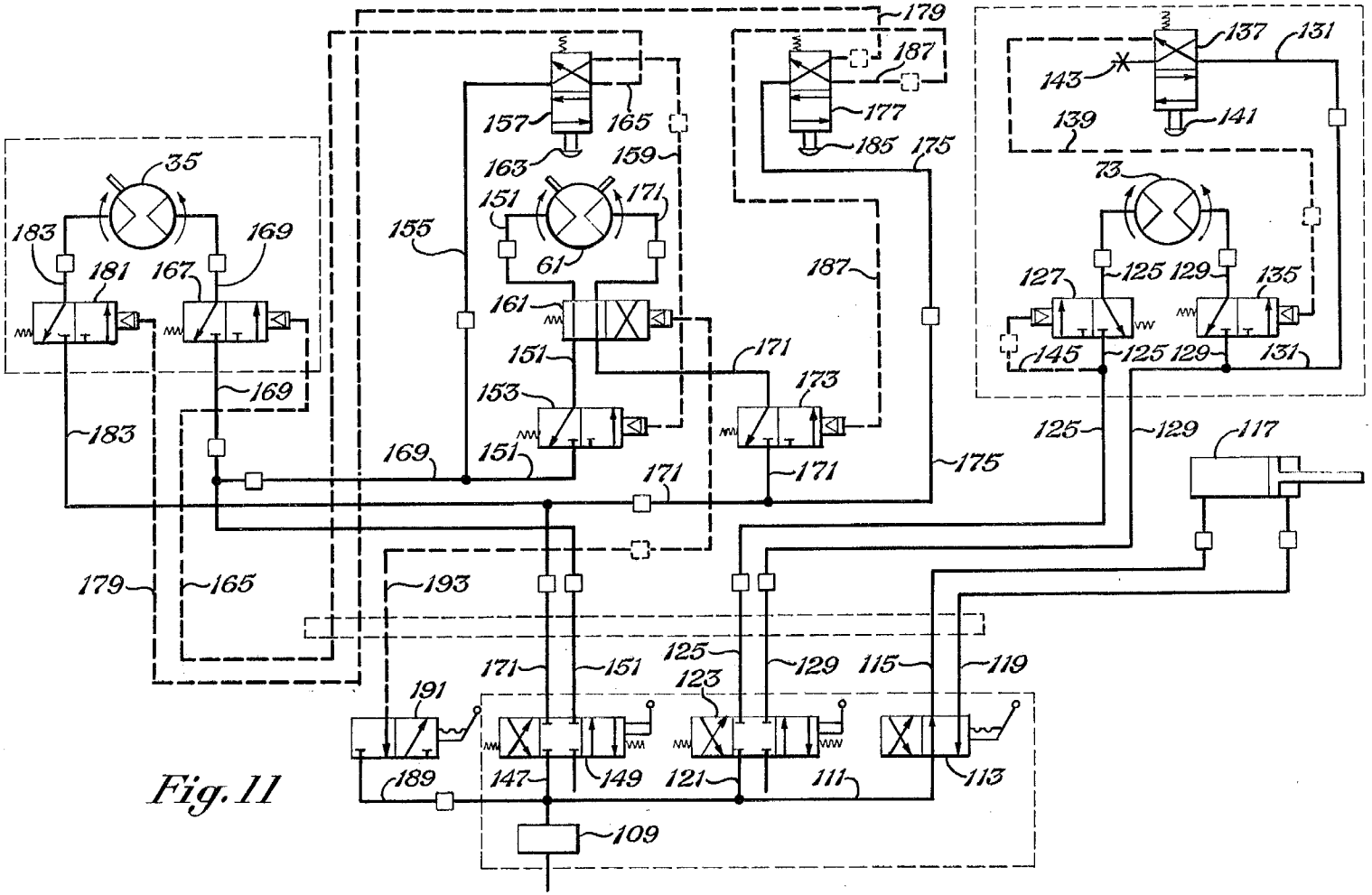
FIG. 11 is a schematic of the control mechanism of the apparatus.

When the controls are as shown in FIG. 11, the trolley 23 is at the end of track 21 opposite motor 35 and power arm 87 is completely retracted and aligned along the longitudinal axis of track 21. The right-left selector valve 111 is preset before the trip is made to allow racking to either the right or left side of fingerboard 13. In normal operation, one side of the fingerboard 13 is completely racked before racking the opposite side. In FIG. 11, valve 191 has geen preset to rack the right side of the fingerboard 13.

Power arm control valve 123 is shifted to the left causing pressure to flow through valve 127 to motor 73 to extend the power arm. The pipe gripping head 101 is in the open position with the head control valve 113 in the position shown in FIG. 11. When the gripping head 101 engages the pipe 11, the head control valve 113 is shifted to the right to close the head on the pipe as shown in solid lines in FIG. 9.

Power arm control valve 123 is then shifted to the right sending a pilot signal to valve 135 thereby causing pressure to flow through valve 135 to motor 73 to retract the power arm 87. Biasing means comprising cam operated valve 137 prevent a mechanical lock-up of the power arm. Without such biasing means, motor 73 would operate at full speed to torque-up the worm gear 77 and nut 83 to such a degree that motor 73 would not be able to overcome the torque to reverse the operation and extend the arm 87. Prior to torque-up, cam operated valve 137 is actuated as previously described to shut off the air supply to motor 73 and stop movement of the worm gear 77. When the pipe 11 is in contact with the end of the monkeyboard 19, the operator shifts the trolley control valve 149 to the right. Valves 153 and 167 are initially blocked causing pressure to flow up line 155 to valve 157. A pilot signal coming out port 159 opens valve 153 and powers the turret motor 61 to rotate the turret 41 ninety degrees to the right. At this point, the right cam 166 located driven sprocket 49 depresses cam actuator 163 and blocks flow to valve 153. Pressure flows out port 165 to open valve 157 allowing pressure to pass up line 169 and actuate trolley motor 35.

By moving the trolley control valve 149 to the center position shown in FIG. 11, the trolley 23 is stopped at the desired position along fingerboard 13. The operator then extends the power arm 87 as previously explained to place the top of pipe 11 in the selected rack 15 as shown in dotted lines in FIG. 9. The head control valve 113 is shifted to the left to open the head 101 and release the pipe 11. Power arm 87 is retracted by shifting valve 123 to the right. The trolley control valve 149 is then shifted to the left allowing the flow to pass up line 171 to reverse the above procedure and return the apparatus to the starting position.

The operation of cam operated valves 157 and 177 described above will not allow the turret 41 to rotate unless the trolley 23 is at the end of track 21 opposite motor 35. The trolley 23 cannot be moved along the track 21 in the direction of motor 35 unless the turret 41 has been rotated ninety degrees. Thus, using the preferred control mechanism, the power arm 87 will always be rotated ninety degrees from the position shown in FIG. 1 when the trolley is at an intermediate position along the track. This feature of the preferred control mechanism is designed to prevent an operator from accidentally ramming the monkeyboard 19 with a stand of pipe.

It should be apparent to those skilled in the art that the above described apparatus has a rugged construction that will enhance reliability and minimize maintenance. The straight line mechanism composed essentially of the power arm 87 and scissor arm 93 can be used to move the pipe gripping head 101 into engagement and disengagement with the pipe 11. The use of first and second support arms 95 and 99 and cross bar 89 to form a pair of parallelograms maintains the pipe gripping head in a horizontal position and adds stability.

While the invention has been shown in only one of its forms, it should be apparent to those skilled in the art that it is not thus limited but is susceptible to various changes and modifications without departing from the spirit thereof.

We claim:

1. Apparatus for moving stands of pipe in a derrick, said apparatus comprising:

a powered turret for rotation about a generally vertical axis;

mounting means for positioning said turret at a selected location relative to the derrick;

a generally vertical leg supported and rotated by the turret;

a powered dolly mounted for movement and selected positioning along the vertical leg;

a power arm having one end rotatably mounted to the dolly;

a pipe gripping head mounted to the opposite end of the power arm; and a scissor arm having one end rotatably connected to the power arm and the other end rotatably connected to a selected one of the leg and the turret.

2. Apparatus for moving stands of pipe in a derrick, said apparatus comprising;

a generally horizontal track mounted at a selected location relative to the derrick;

a powered trolley mounted for selected movements and positioning along the track;

a powered turret mounted on the trolley for rotation about a generally vertical axis;

a generally vertical leg supported and rotated by the turret;

a powered dolly mounted for movement and selected positioning along the vertical leg;

a power arm having one end rotatably mounted to the dolly;

a pipe gripping head mounted to the opposite end of the power arm;

a scissor arm having one end rotatably connected to the vertical leg and the other end rotatably connected to the power arm; and biasing means connected to a select one of the vertical leg and turret to urge the pipe gripping head away from the vertical leg when the pipe gripping head is retracted.

3. Apparatus for moving stands of pipe in a derrick, said apparatus comprising:

a generally horizontal track mounted at a selected location relative to the derrick;

a powered trolley mounted for selected movements and positioning along the track;

a powered turret mounted on the trolley for rotation about a generally vertical axis;

a generally vertical leg supported and rotated by the turret;

a powered dolly mounted for movement and selected positioning along the vertical leg;

a power arm having one end rotatably mounted to the dolly;

a pipe gripping head mounted to the opposite end of the power arm;

a scissor arm rotatably connected at one end in the mid-region of the power arm and at the other end to the vertical leg at a point in generally vertical alignment with the point at which the power arm is mounted to the dolly; and biasing means connected to the vertical leg to urge the pipe gripping head away from the vertical leg when the pipe gripping head is retracted.

4. Apparatus for moving stands of pipe in a derrick, said apparatus comprising:

a generally horizontal track mounted at a selected location relative to the derrick;

a powered trolley mounted for selected movements and positioning along the tracks;

a powered turret mounted on the trolley for rotation about a generally vertical axis;

a generally vertical leg supported and rotated by the turret;

a powered dolly mounted for movement and selected positioning along the vertical leg;

a power arm having one end rotatably mounted to the dolly;

a pipe gripping head mounted to the opposite end of the power arm;

a cross bar having a first and second pivot points connected at the first pivot point to the mid-region of the power arm;

a scissor arm having one end rotatably connected to the power arm coincidentally with the first pivot point of the cross bar and the other end rotatably carried by the vertical leg;

a first support arm connected at one end to the second pivot point of the cross bar and at the other end to the vertical leg at a point near to and horizontally aligned with the point at which the scissor arm is connected to the vertical leg said first support arm being of equal length to the scissor arm;

a second support coincidentally connected at one end to the second pivot point of the cross bar and at the other end to the pipe gripping head at a point near to and horizontally aligned with the point at which the power arm is connected to the pipe gripping head so that the distance between these two points, between the pivot points of the cross bar, and between the points at which the first support arm and scissor arms connect to the vertical leg are all approximately the same; and biasing means connected to the vertical leg to urge the pipe gripping head away from the vertical leg when the pipe gripping head is retracted.

* * * * *

UNITED STATES PATENT OFFICE

CERTIFICATE OF CORRECTION

Patent No. 4,345,864 Dated August 24, 1982

Inventor(s) ROGER SMITH, JR., et al

It is certified that error appears in the above-identified patent and that said Letters Patent are hereby corrected as shown below:

At column 2, line 54, "pproximately" should be --approximately--;
At column 3, line 53, "mouted" should be --mounted--;
At column 5, line 14, "horiozontal" should be --horizontal--;
At column 5, line 26, "since" should be --source--;
At column 7, line 31, --on-- should be inserted before "driven".

Signed and Sealed this

Twenty-ninth Day of March 1983

[SEAL]

Attest:

GERALD J. MOSSINGHOFF

Attesting Officer

Commissioner of Patents and Trademarks